US005217389A

United States Patent [19]

MacKay et al.

[11] Patent Number: 5,217,389

[45] Date of Patent: Jun. 8, 1993

[54] ADJUSTABLE STRAIN RELIEF FOR WIRING DEVICES

[75] Inventors: Peter A. MacKay, Warwick; Scott A. Boyer, North Providence; Alan A. Archambault, Smithfield, all of R.I.

[73] Assignee: General Electric Company, Schenectady, N.Y.

[21] Appl. No.: 939,327

[22] Filed: Sep. 2, 1992

[51] Int. Cl.[5] ..... H01R 13/58

[52] U.S. Cl. ..... 439/466; 439/459

[58] Field of Search ..... 439/465, 467, 466, 459, 439/456, 460, 463, 468

[56] References Cited

U.S. PATENT DOCUMENTS

| | | | |
|---|---|---|---|
| 3,056,942 | 10/1962 | Carbaugh et al. | 439/362 |
| 3,461,417 | 8/1969 | Schumacher et al. | 439/106 |
| 3,571,781 | 3/1971 | Gartland, Jr. et al. | 439/465 |
| 3,621,449 | 11/1971 | Bridle | 439/463 |
| 3,671,921 | 6/1972 | Baker, III et al. | 439/353 |
| 3,747,049 | 7/1973 | Cressman et al. | 439/466 |
| 3,854,787 | 12/1974 | Snyder, Jr. | 439/469 |
| 3,904,265 | 9/1975 | Hollyday et al. | 439/469 |
| 3,981,555 | 9/1976 | Deurloo | 439/456 |
| 4,108,526 | 8/1978 | McKee | 439/466 |
| 4,138,185 | 2/1979 | Jaconette, Jr. | 439/467 |
| 4,191,444 | 3/1980 | Smith et al. | 439/459 |
| 4,208,085 | 6/1980 | Lawrence et al. | 439/462 |
| 4,323,725 | 4/1982 | Muller | 439/459 |
| 5,041,013 | 8/1991 | Greenbaum | 439/425 |

FOREIGN PATENT DOCUMENTS

| | | | |
|---|---|---|---|
| 138392 | 10/1979 | German Democratic Rep. | 439/460 |
| 1209452 | 10/1970 | United Kingdom | 439/456 |

*Primary Examiner*—Gary F. Paumen

*Attorney, Agent, or Firm*—Edward M. Corcoran; Stanley C. Corwin

[57] ABSTRACT

An electrical connector is provided with an adjustable strain relief including a pair of movable barriers captively mounted by the connector housing for selective rotational positioning such as to cooperate with fixed barriers formed on the two parts of the connector housing in providing strain relieving labyrinth grips on the terminal portions of at least two sizes of electric cord.

18 Claims, 2 Drawing Sheets

FIG. 3
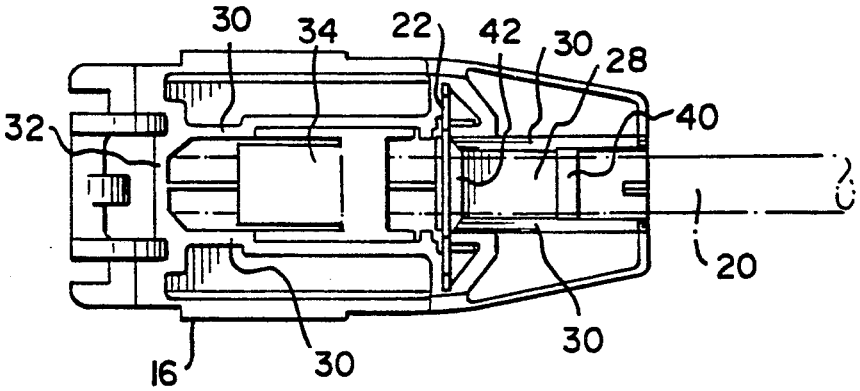
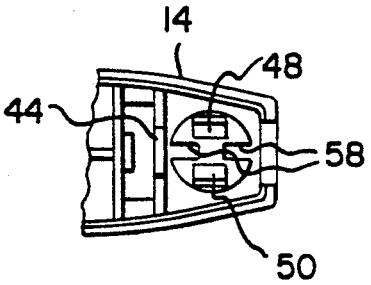
FIG. 4
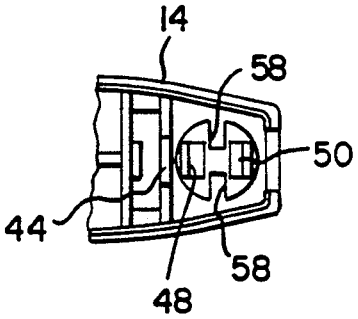
FIG. 5
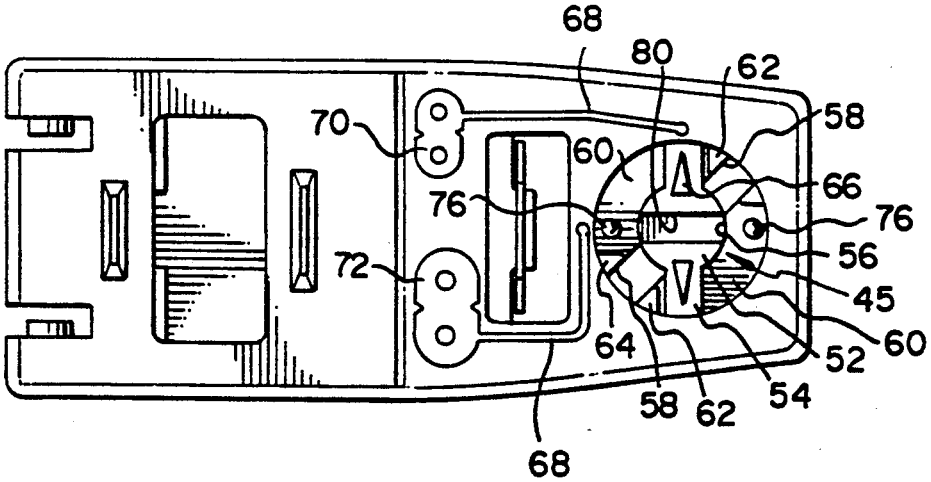
FIG. 6

ADJUSTABLE STRAIN RELIEF FOR WIRING DEVICES

The present invention relates to wiring devices and particularly to electrical connectors, such as plugs and receptacles, utilized as terminations for electrical cords.

BACKGROUND OF THE INVENTION

Electrical connectors for terminating the ends of extension cords, lamp cords, small appliance cords, etc., are commonplace items in the home. Original equipment connector-terminated electric cords are typically manufactured with the cord insulation and the connector body or housing intimately bonded together or molded in integral relation. As such, adequate strain relief for the cord is provided to prevent separating the connections between the cord wires and their terminating electrical connector elements should the cord and connector body be repeatedly subjected to tension.

Unfortunately, after prolonged abuse, the electrical connection between a cord wire and plug or receptacle connector element tends to break, and a replacement plug or receptacle must be then installed to reterminate the electric cord. The replacement connector should be equipped with appropriate strain relief provisions such that the cord is gripped by the connector body during installation to prevent premature failure of a cord wire/connector element connection or joint. It will be appreciated that reliable strain relief is especially important in the case of those connectors that rely on insulation piercing prongs or barbs to make electrical connections between the cord wires and the connector elements (plug blades or receptacle jaws).

Typically the strain reliefs provided in replacement electrical connectors are designed for a particular cord size. Unfortunately, electrical cords in residential applications can be and typically are of different sizes. Thus, the do-it-yourselfer must be sure to obtain a replacement connector that is specifically designed for the size of the cord to be reterminated, which can be a hit or miss proposition for the inexperienced. Previous attempts to provide replacement connectors adaptable to different cord sizes have resorted to the selective use of cord gripping inserts, which are susceptible to being misplaced. Other designs utilize wedge elements which are selectively, adjustably crammed into gripping engagement with the cord by the installer. Both of these approaches require the installer to use a certain degree of judgment to achieve adequate strain relief.

SUMMARY OF THE INVENTION

It is accordingly an objective of the present invention to provide a wiring device, such as an electrical plug or receptacle connector, equipped with a strain relief that is readily and simply adjustable to accommodate electrical cords of different sizes. To this end, the connector includes a two-part housing, wherein at least one of the housing parts is provided with a longitudinal guideway for receiving the terminal portion of an electric cord. A plurality of longitudinally distributed, fixed barriers are formed in the two housing parts in transverse relation to the guideway, such as to produce a first strain relieving labyrinth grip on the cord terminal portion of a large size cord when the housing parts are secured in mated relation.

One of the housing parts captively mounts at least one movable barrier which is selectively manipulated by the installer either into a longitudinal orientation disassociated from the first labyrinth grip or into a transverse orientation to produce, in combination with at least one of the fixed barriers, a second strain relieving labyrinth grip on the terminal portion of a small size cord disposed in the guideway as the housing parts are secured in mated relation.

In the preferred embodiment of the invention, two movable barriers are commonly mounted by a carrier which is, in turn, mounted by the one housing part for limited 90° rotation. Indicia borne by the housing indicate to the installer the appropriate angular carrier position providing the requisite movable barrier orientation for the cord size involved. Detents maintain the movable carrier orientation selected by the installer during installation and also provide tactile feedback that the movable barriers are properly in their selected orientation.

BRIEF DESCRIPTION OF THE DRAWINGS

For a full understanding of the nature and objects of the present invention, reference may be had to the following Detailed Description taken in conjunction with the accompanying drawings, in which:

FIG. 3 is an interior plan view of one of the housing parts for the electrical connector of FIGS. 1 and 2;

FIG. 4 is a fragmentary interior plan view of the other of the connector housing parts, depicting the adjustable strain relief position illustrated in FIG. 2.

FIG. 5 is a fragmentary interior plan view of the other of the connector housing parts, depicting the adjustable strain relief position illustrated in FIG. 1; and FIG. 6 is an exterior plan view of the other housing part.

Corresponding reference numerals refer to like parts throughout the several views of the drawings.

DETAILED DESCRIPTION

Figure 1:
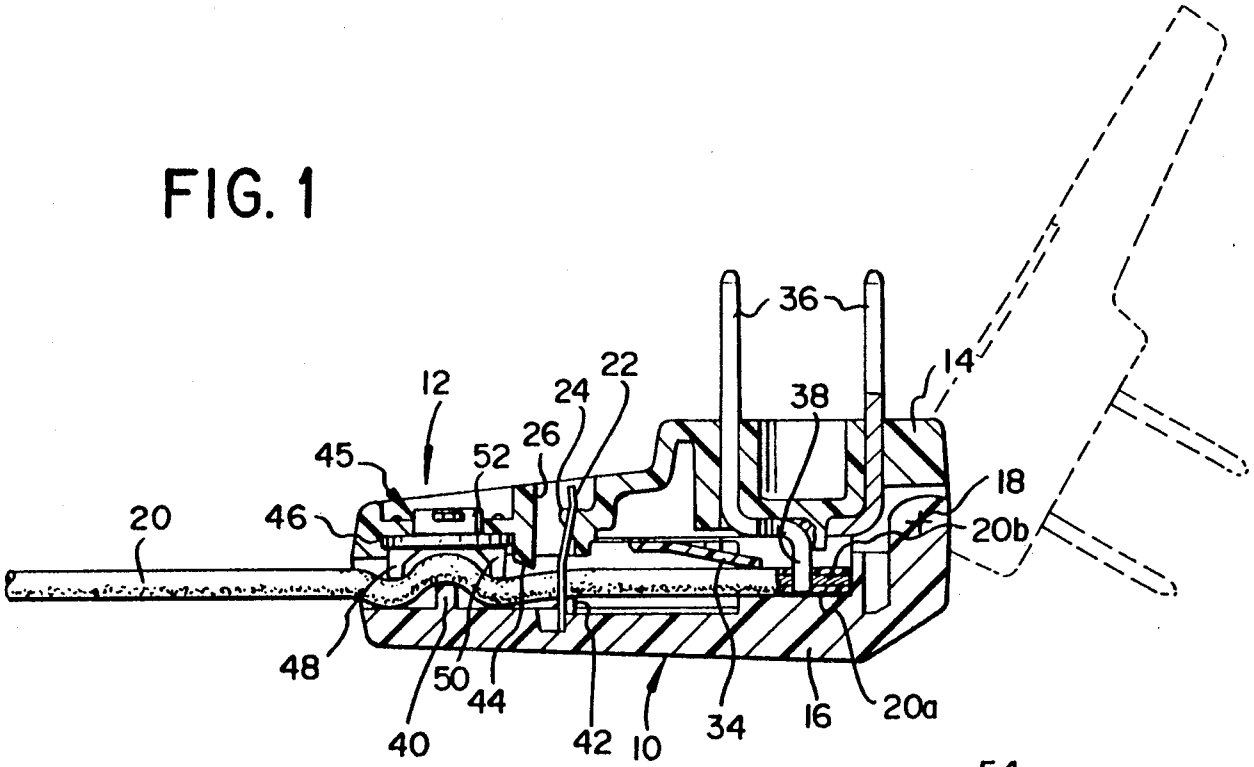
FIG. 1 is a longitudinal sectional view of an electrical connector incorporating the strain relief of the present invention adjusted to accommodate a small size electric cord.
Figure 2:
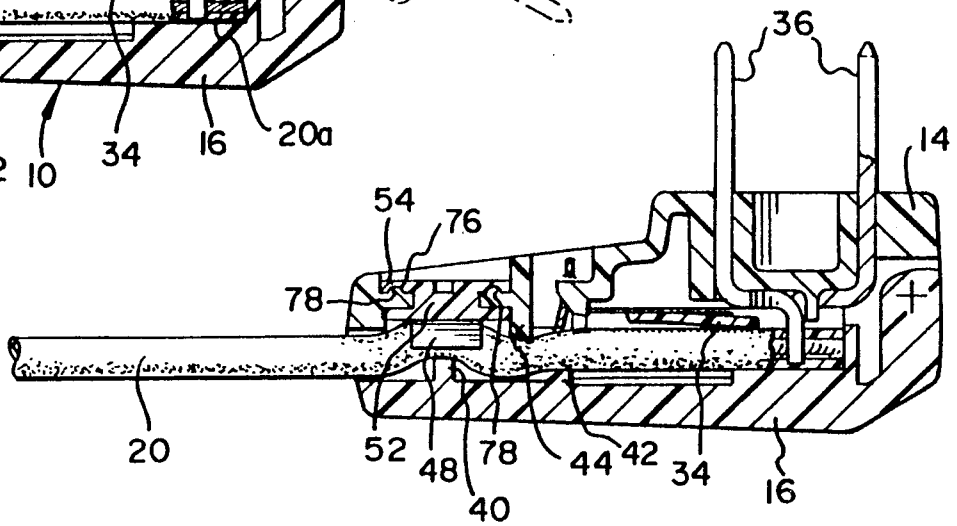
FIG. 2 is a longitudinal sectional view of the electrical connector of FIG. 1, wherein the strain relief is adjusted to accommodate a large size electric cord.

FIGS. 1 and 2 illustrate in longitudinal cross section an electrical plug connector, generally indicated at 10, which incorporates an adjustable strain relief in accordance with the present invention as generally indicated at 12. The connector includes a two-part housing consisting of a base 14 and a cover 16 which are hinged together at 18, such that the housing parts can be swung open, as illustrated in phantom, to accommodate electrical installation of the connector to the end of an electric cord 20. The housing parts are secured in the closed, mated relation seen in FIGS. 1 and 2 by a resilient clip 22 secured at its illustrated lower end to cover 16 and configured to releaseably engage a latching nose 24 formed on base 14. The free end of the clip is accessible in an opening 26 in the base to disengage the clip from the latching nose and thus permit separation of the housing parts preparatory to connector installation. It will be appreciated that, in lieu of the hinge/latch connections of the housing parts, they may be united by plural, removable fasteners, such as screws.

Cover 16 is formed, as best seen in figure 3, with a longitudinal guideway 28 essentially defined by raised, transversely spaced, longitudinally extending ribs 30.

The terminal portion of an electric cord 20 that is to be electrically terminated with connector 10 is inserted longitudinally along the guideway until the cord end abuts a transverse guideway endstop 32. The cord terminal portion extends through an opening in clip 22 and under a leaf spring 34 serving to press the cord terminal portion against the guideway floor.

Base 14, as seen in FIGS. 1 and 2, fixedly mounts a pair of connector elements, each integrally formed having an external blade 36 and an internal prong or barb 38. Thus, when the housing parts are mated, the barbs pierce the cord insulation 20*a* and make electrical connection with the cord stranded wire conductors 20*b* pursuant to installation of the connector to cord 20.

To provide strain relief for the cord, cover 16 is formed with a pair of fixed, longitudinally spaced barriers 40 and 42 oriented transversely of guideway, as seen in FIGS. 1–3. Base 14, as also seen in FIGS. 4 and 5, is formed with a fixed barrier 44 which assumes a position transverse of the guideway and intermediate the cover barriers 40 and 42 when the housing parts are mated. Thus, as seen in FIG. 2, when the terminal portion of a large size cord 20 is disposed in guideway 28, and the cover and base latched in closure relation, barriers 40, 42 and 44 effect a labyrinth grip on the cord terminal portion to provide effective strain relief preventing the cord from being separated from connector 10.

In the illustrated embodiment of the invention, adjustable strain relief 12 is only involved in a strain relieving labyrinth grip of a cord of a smaller size than that illustrated in FIG. 2. Thus, as seen in FIGS. 1, 2 and 6, the adjustable strain relief comprises a carrier, generally indicated at 45, including a disk 46 serving to mount a pair of spaced, parallel barriers 48 and 50 upstanding from its inner side. A central post 52 projects from the outer side of the disk and is provided with a pair of laterally extending, diametrically opposed ears 54 in closely spaced, parallel relation to the disk. To captively mount the carrier to the connector, base 14 is provided with a keyhole slot which, as seen in FIG. 6, is configured to have a central, circular opening 56 of a diameter slightly larger than the post diameter and diametrically opposed, laterally extending slots 58 dimensioned to permit the insertion of ears 54 therethrough. To assemble the carrier to the base, the post and ears are inserted through the keyhole slot from the inner side of the base. When disk 46 abuts the inner side of semi-circular shelves 60 intermediate slots 58, the carrier is rotated to swing ears 54 out of registry with the slots. Thus, the carrier becomes captively mounted to the base with the shelves received in the close-fitting space between the disk and ears.

To permit carrier assembly while discouraging disassembly, diametrically opposed, a ramped stop 62 is positioned adjacent one edge of each slot 58. Once the carrier is inserted in the keyhole slot and rotated in the counter-clockwise direction illustrated in FIG. 6, the ears are ramped up and over the revelled front sides of stops 62. Once clear of these stops, their straight, back sides limit reverse rotation of the carrier to an angular position short of registering the ears with slots 58. Thus inadvertent disassembly is precluded. Additional stops 64 are stationed adjacent the slot edges in opposed relation to stops 62 to limit counter-clockwise rotation short of also registering the ears with the slots. It is thus seen that stops 62 and 64 preserve the captive, rotational mounting of the carrier to the base and also serve to limit the extent of permissible carrier rotation to 90°.

When carrier 45 is angularly positioned as illustrated in FIGS. 2 and 4, its barriers 48 and 50 are longitudinally oriented to in effect straddle guideway 28. It is thus seen that, as noted above, these movable barriers do not participate in the strain relieving labyrinth grip of the large size cord. However, when the carrier is rotated 90°, its barriers 48 and 50 are oriented transversely of the guideway, as illustrated in FIGS. 1 and 5, and, when the housing parts are closed, act with intervening cover barrier 40 to produce a strain relieving labyrinth grip on the terminal portion of a smaller size cord.

To ensure proper installation, indicia depicting the most common large cord size, SPT-2 (16 and 18 AWG), and small cord size, SPT-1 (18 AWG), is provided on the exterior surface of base 14. The outer faces of ears 54 bear arrow heads 66 which indicate , when pointing to the terminations of respective lead lines 68 running to depictions 70 (SPT-1) and 72 (SPT-2) of the two cord sizes, the appropriate carrier position for the cord size involved. The arrow heads can also serve to indicate the orientation of barriers 48 and 50.

As a further convenience to the installer in achieving proper carrier angular positioning and to preserve the selected carrier position during installation, detents in the form of bumps 76 formed in the surface of shelves 60 and dimples 78 formed in the undersides of ears 54 are provided. The bumps are located such that, when the carrier is in either of its two different cord size positions, they snap into respective dimples to also provide tactile feedback to the user that the movable barriers are properly positioned in each case. The head of post 52 is provided with a slot 80 for accepting a tool, such as a coin, screwdriver, etc., to facilitate rotational positioning of the carrier.

While the strain relief of the present invention is illustrated as having two movable barriers cooperating with one fixed barrier to effect a labyrinth grip on a cord, it will be appreciated that one movable barrier could cooperate with a single or a pair of fixed barriers to provide a strain relieving cord grip. Furthermore, rather than having the adjustable strain relief barrier participate only in a labyrinth grip of a small electric cord, additional shorter barriers may be provided in orthogonal relation to barriers 48 and 50 for participation in a labyrinth grip of a large (SPT-2) cord.

It will be further appreciated that the adjustable strain relief of the present invention is equally adaptable to an electrical cord terminating receptacle connector in the same manner as illustrated herein for a cord terminating plug. In addition, the present invention is not limited in application to connectors using insulation-piercing barbs to effect electrical connection with the cord conductors. Rather, such connections may be made via binding head screws.

From the foregoing Detailed Description, it is seen that the objectives of the present invention are efficiently and effectively achieved, and, since certain changes may be made in the constructions set forth, it is intended that matters of detail be taken as illustrative and not in a limiting sense.

Having described the subject invention, what is new and desired to secure by Letters Patent is:

1. An electrical connector comprising, in combination:

A. a housing having first and second parts;

B. electrical connector elements secured in said housing;

C. a longitudinal guideway internally formed in said housing for receiving a terminal portion of an electric cord introduced through an opening in said housing and extending to a site of electrical connection with said connector elements;

D. a plurality of fixed transverse barriers formed on said first and second housing parts in distributed relation along said guideway to produce a first labyrinth grip on the terminal portion of a cord of a first size when said housing parts are secured in mated relation to form said housing; and E. at least one movable barrier captively mounted by one of said first and second housing parts for movement between a first position disassociated from said first labyrinth grip and a second position in transverse relation with said guideway to produce, in cooperation with at least one of said fixed barriers, a second labyrinth grip on the terminal portion of a cord of a second size smaller than said first cord size when said housing parts are secured in mated relation to form said housing.

2. The electrical connector defined in claim 1, wherein said movable barrier is mounted for rotational movement between said first position parallel to and aside of said guideway and said second position.

3. The electrical connector defined in claim 2, which includes first and second said movable barriers commonly mounted in spaced, parallel relation, said first and second barriers straddling said guideway in said first position and parallel to and straddling at least one of said fixed barriers in said second position.

4. The electrical connector defined in claim 3, wherein said guideway and said one fixed barrier are formed in said first housing part, and said first and second barriers are rotataively mounted by said second housing part.

5. The electrical connector defined in claim 4, wherein said second housing part includes a keyhole slot, said electrical connector further comprising a carrier for said first and second barriers, said carrier including 1) a disk having first and second opposed sides, said first and second barriers depending from said first disk side,
2) a vertical post projecting from said second disk side, and
3) a pair of ears projecting laterally from said post,
4) whereby, upon insertion of said post and said ears through said keyhole slot and rotation of said carrier to swing said ears out of registry with said keyhole slot, said carrier becomes captively, rotataively mounted by said second housing part.

6. The electrical connector defined in claim 5, which further includes detent means provided on said carrier and said second housing part to provide tactile feedback during manual rotation of said carrier of when said first and second barriers are located in said first and second positions.

7. The electrical connector defined in claim 5, wherein said second housing part is provided with raised stops to prevent rotation of said ears into registry with said keyhold slot.

8. The electrical connector defined in claim 7, wherein two of said stops are ramped-shaped to permit rotation of said ears past said two stops during assembly of said carrier to said second housing part.

9. The electrical connector defined in claim 8, wherein a slot is formed in a free end of said post to receive a tool facilitating manual rotation of said carrier to locate said first and second barriers in said first and second positions.

10. The electrical connector defined in claim 8, which further includes indicia borne by said second housing part indicating the angular position for said carrier to locate said first and second barriers to the appropriate one of said first and second positions depending on the one of said first and second cable size terminal portions received in said guideway.

11. An electrical connector comprising in combination:

A. a housing having first and second parts;

B. electrical connector elements secured in said housing;

C. a longitudinal guideway internally formed in said first housing part for receiving a terminal portion of an electric cord extending from an opening in said housing to a site of electrical connection with said connector elements;

D. at least one first barrier formed in said first housing part in transverse relation to said guideway;

E. at least one second barrier carried by said second housing part; and

F. a pair of third, parallel, spaced barriers captively mounted by said second housing part for rotation selective between first and second positions, (1) said third barriers, in said first portion being longitudinally oriented in straddling relation to said guideway, such that said first and second barriers produce a strain relieving grip on the terminal portion of a cord of a first size when said first and second housing parts are secured in mated relation, and (2) said third barriers, in said second position, being transversely oriented to said guideway in straddling relation with said first barrier to produce a strain relieving grip on the terminal portion of a cord of a second size when said first and second housing parts are secured in mated relation.

12. The electrical connector defined in claim 11, which further includes a pair of longitudinally spaced said first barriers formed on said first housing part in transverse relation to said housing, said pair of first barriers straddling said second barrier formed on said housing part to grip the terminal portion of the first size cord, in said second position, said third barriers straddling one of said pair of first barriers to grip the terminal portion of the second size cord.

13. The electrical connector defined in claim 12, wherein said second housing part includes a keyhole slot, said electrical connector further comprising a carrier for said third barriers, said carrier including 1) a disk having first and second opposed sides, said third barriers depending from said first disk side,
2) a post projecting from said second disk side, and
3) a pair of ears projecting laterally from said post,
4) whereby, upon insertion of said post and said ears through said keyhole slot and rotation of said carrier to swing said ears out of registry with said keyhole slot, said carrier becomes captively, rotataively mounted by said second housing part.

14. The electrical connector defined in claim 13, wherein said second housing part is provided with raised stops to prevent said ears from swinging into registry with said keyhole slot and to limit said carrier to essentially 90° rotation between said first and second positions.

15. The electrical connector defined in claim 14, wherein at least one of said stops is ramped-shaped to permit swinging of said ears past said one stop during assembly of said carrier to said second housing part.

16. The electrical connector defined in claim 15, which further includes detent means provided on said carrier and said second housing part to retain said third barriers in a selected one of said first and second positions as said first and second housing parts are secured in mated relation.

17. The electrical connector defined in claim 15, wherein a slot is formed in a free end of said post to receive a tool facilitating manual rotation of said carrier to locate said third barriers in said first and second positions.

18. The electrical connector defined in claim 15, which further includes indicia borne by said second housing part indicating the angular position for said carrier to locate said third barriers to the appropriate one of said first and second positions depending on the one of said first and second cable size terminal portions received in said guideway.

* * * * *